US007827963B2

(12) United States Patent
Li et al.

(10) Patent No.: US 7,827,963 B2
(45) Date of Patent: Nov. 9, 2010

(54) METHOD OF ADAPTING CLOSE-LOOP PRESSURE CONTROL IN A COMMON-RAIL INJECTION SYSTEM FOR AN INTERNAL COMBUSTION ENGINE AND MEANS FOR EXECUTING THE METHOD

(75) Inventors: Hui Li, Regensburg (DE); Diego Valero-Bertrand, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 828 days.

(21) Appl. No.: 11/608,524

(22) Filed: Dec. 8, 2006

(65) Prior Publication Data

US 2007/0251506 A1 Nov. 1, 2007

(30) Foreign Application Priority Data

Dec. 9, 2005 (DE) ..... 10 2005 058 966

(51) Int. Cl.
*F02M 69/54* (2006.01)

(52) U.S. Cl. ..... 123/457; 123/456

(58) Field of Classification Search ..... 123/446, 123/456, 457, 458, 527
See application file for complete search history.

(56) References Cited

U.S. PATENT DOCUMENTS

| | | | | |
|---|---|---|---|---|
| 6,142,120 | A | 11/2000 | Biester et al. | 123/456 |
| 6,439,199 | B2 * | 8/2002 | Ramseyer et al. | 123/446 |
| 6,644,277 | B2 * | 11/2003 | Blass et al. | 123/446 |
| 6,668,801 | B2 * | 12/2003 | Smith et al. | 123/446 |
| 6,672,285 | B2 * | 1/2004 | Smith et al. | 123/446 |
| 7,163,001 | B2 | 1/2007 | Jung et al. | 123/458 |
| 2005/0241624 | A1 * | 11/2005 | Ricco et al. | 123/527 |

FOREIGN PATENT DOCUMENTS

| | | | |
|---|---|---|---|
| DE | 195 48 278 | A1 | 6/1997 |
| DE | 197 31 994 | A1 | 1/1999 |
| DE | 10 2004 009 616 | A1 | 9/2005 |
| EP | 1 030 047 | A2 | 8/2000 |
| EP | 1 529 940 | A2 | 5/2005 |

* cited by examiner

*Primary Examiner*—Stephen K Cronin
*Assistant Examiner*—J. Page Hufty
(74) *Attorney, Agent, or Firm*—King & Spalding L.L.P.

(57) ABSTRACT

In a method for adaptation of closed-loop control of a pressure in a common-rail injection system (3) for an internal combustion engine (1), with the closed-loop control having a pilot control and the common-rail injection system (3) with at least a correction device (11) able to corrected by corrective signals in each case corresponding to corrective values for influencing the pressure, a pilot control value for generating at least one corrective signal for the correction device (11) is determined, and using the pilot control value by generating the at least one corrective signal and issuing it to a correction device, the current pressure is corrected to a predetermined setpoint pressure. For adaptation the pilot control is adapted as a function of at least one current value of an operating parameter of the internal combustion engine (1) and of the corrective value corresponding to the at least one corrective signal.

22 Claims, 5 Drawing Sheets

METHOD OF ADAPTING CLOSE-LOOP PRESSURE CONTROL IN A COMMON-RAIL INJECTION SYSTEM FOR AN INTERNAL COMBUSTION ENGINE AND MEANS FOR EXECUTING THE METHOD

RELATED APPLICATION

This application claims priority from German Patent Application No. DE 10 2005 058 966.9, which was filed on Dec. 9, 2005, and is incorporated herein by reference in its entirety.

TECHNICAL FIELD

The present invention relates to a method of adapting closed-loop pressure control in a common-rail injection system for an internal combustion engine and to means for executing the method.

BACKGROUND

In fossil fuel motors, especially internal combustion engines, when a direct injection system is used, the fuel for combustion is injected directly into the combustion chamber. An injection system frequently used for this purpose is common-rail injection. In common rail injection systems a high-pressure pump pressurizes the fuel to a high level. The pressurized fuel fills a system of tubes or one or more pressure lines, which is or are constantly under pressure while the engine is in operation. The fuel is injected into the combustion chamber by actuating electrically-operated injection valves connected to the pressure line. The injection time and the injection amount are controlled by the engine electronics which issues the corresponding injection signals to the injection valves. Such common-rail injection systems can be used for gasoline engines and especially for diesel engines for example.

The size of the quantity injected into a cylinder in each case influences factors such as the combustion cycle, the emissions, the torque produced and the noise produced by the engine.

The injection quantity is determined by factors such as the valve opening time and the pressure in the pressure line. To actually enable the desired injection volume for an injection to be injected into a cylinder with high accuracy, it is thus necessary to be able to adjust the pressure in the common-rail injection system, i.e. in the pressure line or lines, as precisely as possible.

Closed-loop pressure control is thus provided in common-rail-injection systems, by means of which the pressure in the injection system is controlled to a setpoint pressure value, which as a rule depends on operating parameters of the internal combustion engine. Basically simple closed-loop control can be used for this purpose. The disadvantage of this however is that, if there is a rapid change in the setpoint pressure value, significant time is needed for the closed-loop control system to adjust the current pressure value to the setpoint pressure value.

It is thus conceivable to use a pilot control for closed-loop control. This is used, depending on the values of the operating parameters, to adjust the common-rail injection system or devices within it by means of which its pressure can be influenced, so that, even on the basis of the pilot control, the setpoint pressure value is obtained as well as possible and precision control around the operating point predetermined in this way only then has to compensate for small control deviations. In this way the actual pressure value can be rapidly adjusted to the setpoint pressure value even if there are rapid changes to the latter.

Engine maps can be used for pilot control for example, which, depending on an operating parameter in each case, represent a contribution for a value to be set for the devices. The engine maps are determined in such cases for a predetermined type of common-rail injection system, for example using a standard system with modules used as standard or by forming an average from a number of common-rail injection systems of the same type used for determination.

Manufacturing tolerances and wear and tear in injection systems however lead to the accuracy of the engine map for an individually determined common-rail injection system not being as great as desired or to the accuracy reducing over time. In particular the characteristics of an individually predetermined common-rail injection system can deviate from the values assumed or determined on creation of the engine map, for example of the standard system, so that the engine maps do not allow precise pilot control. The result is that it can take an inordinately long time for the closed-loop control to correct the actual pressure to the setpoint pressure, since after a change in the operating parameters defining the operating point of the internal combustion engine and thereby the setpoint value as well as the pilot control, a relatively great control deviation can occur.

SUMMARY

The underlying object of the present invention is thus to effectively improve the closed-loop control of the pressure in a common-rail injection system so that a predetermined setpoint value can be obtained even for an individual common-rail injection system.

The object is achieved by a method for adapting closed-loop pressure control in a common-rail injection system for an internal combustion engine, with the closed-loop control including a pilot control and the common-rail injection system featuring at least one correction device able to be corrected by corrective signals which correspond to corrective values in each case for influencing the pressure, in which a pilot control value is determined for generating at least one corrective signal for the correction device, by using the pilot value by generating the at least one corrective signal and issuing it to the correction device, the current pressure is corrected to a predetermined setpoint pressure, and for adaptation the pilot control is adapted depending on at least one current value of an operating parameter of the internal combustion engine and the corrective value corresponding to the at least one corrective signal.

The object is further achieved by a device for closed-loop pressure control in a common-rail injection system for an internal combustion engine, with the closed-loop control comprising a pilot control and the common-rail injection system featuring at least one correction device able to be corrected by corrective signals which correspond to corrective values in each case for influencing the pressure, and with the device featuring input interfaces for operating parameter signals which represent the values of operating parameters of the internal combustion engine, and for pressure signals which represent the values of the pressure in the common-rail injection system, an output interface for output of corrective signals to the correction device for influencing the pressure, and is embodied for executing the method, and especially for determining a pilot value to generate at least one corrective signal for the correction device, correcting the current pressure to a predetermined setpoint pressure using the pilot value by generating the at least one corrective signal and issuing it to the correction device, and for adaptation, adapting the pilot control depending on at the least one current value of an operating parameter of the internal combustion engine and the corrective value corresponding to at least one corrective signal.

BRIEF DESCRIPTION OF THE DRAWINGS

The invention is explained in greater detail below using examples which refer to the schematic drawing. The figures show.

DETAILED DESCRIPTION

Figure 1:
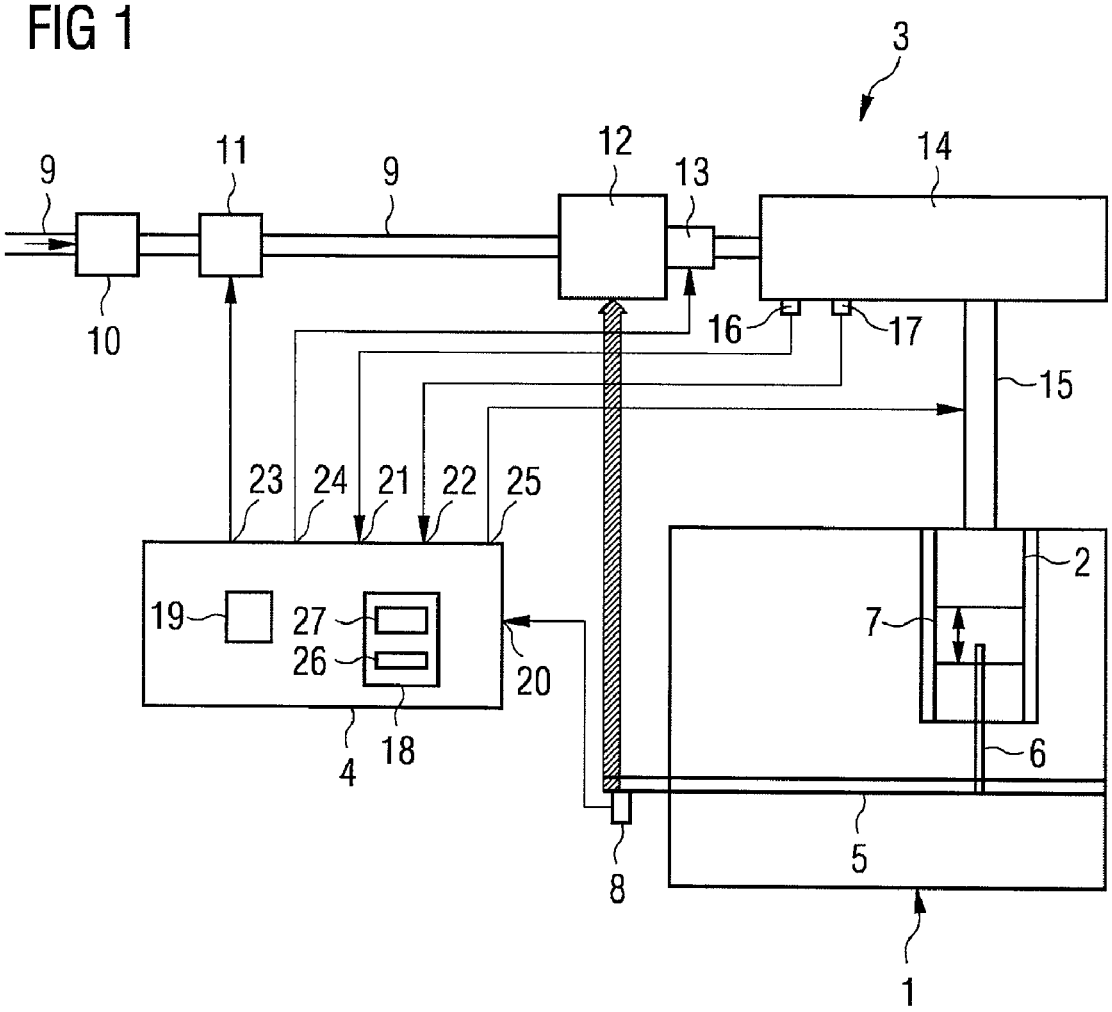
FIG. 1 a schematic diagram of an internal combustion engine with a common-rail-injection system and an engine management device according to a first preferred embodiment of the invention, FIG. 2 a block diagram of a VCV closed-loop control for the pressure in the common-rail injection system in FIG. 1, FIG. 3 a flowchart of a method for adaptation of the closed-loop control in FIG. 2, FIG. 4 a block diagram of a PCV closed-loop control for the pressure in a common-rail-injection system in FIG. 1 and FIG. 5 a flowchart of a further embodiment of a method for adaptation of the closed-loop control in FIG. 2.

The invention is intended for fossil fuel motors, more precisely internal combustion engines, in which fuel is injected into the cylinder or cylinders of the internal combustion engine by a common-rail injection system. The internal combustion engine can have one or preferably more than one cylinder for which an injection valve or a number of injection valves are provided in each case. Gasoline engines and in particular diesel engines are currently regarded as internal combustion engines, however the invention is also suitable for any other motors, especially those with direct injection of the fuel into the cylinder or cylinders.

To this end the common-rail injection system can in particular feature one or more pressure lines in which the fuel to be injected is held under pressure, and at least one electrically-actuatable injection valve connected to the pressure line or lines. For building up and maintaining the pressure at least one further high-pressure pump can be provided which pumps the fuel into the pressure lines. To correct the pressure in the pressure line the at least one correction device is provided which can be activated by correction signals and serves to correct the pressure. A pressure sensor can also be provided in the common-rail injection system or its pressure line, which is used for detecting the pressure in the pressure line or lines and to issue pressure signals which represent the pressure.

The invention is based on closed-loop pressure control, i.e. control of the pressure under which the fuel is held in the pressure line or lines (such as the fuel accumulator or also common rail). To this end the pressure signals of the pressure sensor can be used, which represent the actual values of the pressure. To regulate the pressure on the basis of the actual and setpoint values for the pressure, corrective signals are issued to the correction device which influences the pressure in response to the corrective signals.

The method can be executed with the inventive device. To control the pressure and for adaptation this has input interfaces for operating parameter signals which represent values of operating parameters of the internal combustion engine, for the pressure signals which represent values of the pressure in the common-rail injection system, as well as preferably for setpoint pressure signals which represent the setpoint pressure to be corrected, and at least one output interface for output of corrective signals to the correction device for influencing the pressure. Depending on how the device is embodied, the interfaces can for example be provided by a simple connection or by software interfaces or access to areas of memory in which values uniquely defined by the signals are stored.

Furthermore the device is embodied to execute the method in accordance with the invention, i.e. on the one hand it is embodied to execute the closed-loop control by processing the pressure signals received via the input interface depending on the setpoint value for the pressure, by generating and also issuing at least one corrective signal for the correction device. The corrective signal here represents a corrective value which is determined during closed-loop control.

Basically the device can include the appropriate non-programmable electrical circuits for this purpose. Preferably however the device comprises a processor linked to the input interfaces and the output interface, and a memory in which a computer program product is stored containing instructions which are executed by the processor to carry out the method.

The object of the invention is thus also a computer program product comprising instructions upon execution of which a data processing system carries out the inventive method, and especially instructions for adapting closed-loop pressure control in a common-rail injection system for an internal combustion engine, with the control comprising a pilot control and the common-rail injection system featuring at least one corrective device able to be corrected by corrective signals which correspond to corrective values in each case for influencing the pressure, whereby, on execution of the instructions by a processor of the data processing device, a pilot control value is determined by the processor for generating at least one corrective signal for the correction device, using the pilot control value by generating the at least one corrective signal which corresponds to a corrective value for the correction device and issuing it to the correction device, the current pressure is corrected to a predetermined pressure, and for adaptation the pilot control being adapted depending on at least one current value of an operating parameter of the internal combustion engine and on the corrective value corresponding to the at least one corrective signal.

The data processing device can especially involve a suitably embodied inventive device.

A further object of the invention is a memory medium on which the inventive computer program product is stored, This can especially involve a non-volatile memory, for example an EEPROM.

In the closed-loop control itself the corrective value or the corrective signal are determined by two measures. For pilot control a pilot control value for generating at least one corrective signal is determined. The pilot control value can preferably be determined as a function of at least one of the operating parameter signals also detected via the input interface. Operating parameters are preferably used which represent the operating point of the internal combustion engine and of the common-rail injection system with sufficient precision.

Corrective signals are then generated as a function of the pilot control value and the pressure signal or the pressure and the setpoint pressure so that the pressure is corrected at least approximately to the setpoint pressure. Each of the corrective signals in such case corresponds to a corrective value which is able to be determined using the pilot control value. The corrective value can either be determined from the corrective signal or it can be formed as a function of the pilot control value, which is the preferred method, with the corrective signal then being formed as a function of the corrective value. The pilot control value can especially define the operating point of the closed-loop control so that only a few control steps are needed before the setpoint pressure is reached. This enables the closed-loop control of the pressure, especially with a rapid change of the operating conditions, to be undertaken faster than if the pilot control were not used.

To adapt the pilot control at least one pilot control value is now determined for generating at least one corrective signal for the correction device and the current pressure is corrected to a predetermined setpoint pressure using the pilot control value by generating the at least one corrective signal which corresponds to a corrective value for the correction device and issuing it to the corrective device.

Preferably a number of closed-loop control steps are performed in such cases for an essentially constant pilot control value.

Using the at least one corrective value the pilot control is adapted for at least one current value of the operating parameter. One of the considerations underlying this process is that, with ideal pilot control, except for synchronization processes, no deviations should occur between pilot control value and corrective value; that the corrective value thus corresponds to the pilot control value.

The adaptation is preferably undertaken in such cases so that if the operating parameter values used for the pilot control available at the time when the corrective value is determined are present, a deviation between the pilot control value determined with the adapted pilot control and the corrective value used is smaller than before the adaptation. The pilot control can especially be adapted for example by one parameter of the pilot control predetermined by the at least one operating parameter being modified in suitable manner and stored for further use. The adaptation is also undertaken in this case depending on the current value of at least one predetermined operating parameter. This makes possible pilot control which depends on the current operating point of the internal combustion engine, which takes account of individual deviations of the common-rail injection system and/or the internal combustion engine from predetermined standards and thus allows especially rapid closed-loop control of the pressure.

A further advantage of the invention is that an engine management device which is present in any event, by programming it in an appropriate manner, can preferably be used to control the internal combustion engine as the device for closed-loop control of the pressure in the common-rail injection system. With this embodiment no further devices are thus needed for an internal combustion engine with a common-rail injection system, thus producing an especially simple design. Only the engine management device has to be programmed.

In principle it can be sufficient to use only one corrective value for adaptation. This is especially the case if the closed-loop control has led to a stationary state in which the then at least approximately constant corrective value represents a very good pilot control value. It is however preferable for at least two corrective values to be determined at different points in time and for the pilot control to be adapted in the adaptation depending on the at least two corrective values. To this end the device is preferably further embodied and the computer program preferably comprises a suitable instruction for the device or the processor to determine at least two corrective values at different points in time and to adapt the pilot control during adaptation depending on the at least two corrective values. This embodiment has at least two advantages. One is that a stationary state is not absolutely necessary for adaptation. The other is that a higher accuracy of adaptation can be achieved. From the corrective values of which each corresponds to a corrective signal and which were preferably determined for the same predetermined pilot control value an adaptation value can be determined especially as a result of model assumptions about the behavior of the closed-loop control and/or by averaging which is used for adaptation of the pilot control. The adaptation is undertaken in this case preferably so that if the operating parameter values used for the pilot control available at the time the correction values were determined are present, a deviation between the pilot control value determined with the adapted pilot control and a corrective value determined with the pilot control value is smaller than before the adaptation.

Basically the actual pressure does not yet need to be corrected to the setpoint pressure, i.e. in a stationary state. However it is preferable in the method for the corrective value or the corrective values only to be used for adaptation if this value or these values has been or have been determined in accordance with a predetermined criterion of a suitable approximation to the setpoint pressure. To this end the device is preferably further embodied and the computer program preferably comprises an instruction so that the device or the processor only uses the corrective value or the corrective values for adaptation if this value or these values was or were determined in accordance with a sufficient approximation to the setpoint pressure in accordance with a predetermined criterion. The checking of the criterion is then part of the method. The advantage of this embodiment is of not having to wait for the stationary state to be reached but enabling an adaptation to be undertaken on the basis of just a few suitable corrective values. In particular only the corrective value or values determined after a sufficient approximation need to be used to form an above-mentioned adaptation value. The criterion is preferably selected so that a decision can be made using the criterion as to whether the closed-loop control is occurring within a range favorable for the adaptation. This means that it is not absolutely necessary to wait until the actual pressure value has reached the setpoint pressure value. Instead it is also possible, using a number of corrective values, to adapt the pilot control to the required pressure on synchronization. For example an averaging of the corrective values can be undertaken since when a closed-loop control with proportional component is used the extreme values of the corrective value which are produced by the oscillations around the final value of the corrective value for a stationary state are approximately averaged out. A sufficient approximation can however also be produced if in the area of actual pressures around the setpoint pressure a predetermined, preferably linear, behavior of the closed-loop control to be described by models for example is to be expected. The criterion can further especially involve the timing behavior of the pressure and/or the required values and/or the size of the deviation of the actual pressure from the required pressure or the maximum variation between consecutive corrective values. It can further preferably be selected depending on the accuracy of the closed-loop control to be expected when the internal combustion engine is operated with stationary operating parameters. For example it can be predetermined that the pressure deviates from the required value over a specified period or number of closed-loop control steps by less than a predetermined threshold value. The limit value can be selected depending on the size of a range in which a predetermined timing behavior of the closed-loop control is to be expected and/or on the expected accuracy of the closed-loop control with the given operating conditions.

Especially preferably the criterion can be selected so that a check can be made by means of the criterion as to whether a stationary state of the closed-loop pressure control has been reached. If the pressure is then adjusted to the setpoint pressure in accordance with the criterion, an approximately stationary state is present at least for the duration of the adaptation and the corrective value for the correction device has a constant value which can be assigned to the given operating conditions. Ideally this value corresponds to the pilot control value since closed-loop control around the stationary state then occurs.

Basically any device of the common-rail injection system can be used as the corrective device by means of which the pressure in the pressure line or lines of the common-rail injection system can be, influenced. It is thus conceivable for example for a pump, by means of which the pressure in the pressure line or pressure lines is built up and maintained, to be used as a corrective device. Preferably however the corrective device comprises a valve of the common-rail injection system and the corrective signals are generated for the valve. To this end the device is preferably further embodied and the computer program preferably comprises an instruction so that the device or the processor generates corrective signals for a valve of the common-rail injection system acting as a correction device. The advantage of this is that it enables faster closed-loop control, since valves have considerably faster reaction times to corrected signals than pumps.

In a preferred embodiment the correction device includes a flow control valve for controlling the flow of fuel supplied to a pressure line of the common-rail injection system and the corrective signals are corrective signals for the flow control valve. To this end the device is preferably further embodied and the computer program preferably comprises an instruction so that the device or the processor generates corrective signals for a flow control valve to control the flow of fuel supplied to a pressure line of the common-rail injection system which is at least a part of the correction device. This embodiment is especially suitable for common-rail injection systems which operate according to the VCV (volume control valve) method, i.e. especially also for common-rail injection systems in which for closed-loop control of the pressure, the flow of fuel before the high-pressure pump of the injection system is controlled by the flow control valve. The characteristics of the closed-loop control are determined in this case by the flow control valve.

In another preferred embodiment the correction device comprises a pressure-relief valve for controlling the pressure in a pressure line of the column-rail injection system and the corrective signals are corrective signals for the pressure-relief valve. To this end the device is preferably further embodied and the computer program preferably comprises an instruction so that the device or the processor generates corrective signals for a pressure-relief valve for controlling the pressure in a pressure line of the common-rail injection system which is at least part of the correction device. The characteristics of the closed-loop control are determined in this case by the pressure-relief valve. The advantage of this embodiment is that it is suitable for common-rail injection systems which are operated with the aid of the PCV (pressure control valve) method, i.e. especially also for common-rail injection systems in which, for closed-loop control of the pressure, the flow of fuel after a high pressure pump of the injection system in the pressure line or pressure lines of the fuel-injection system is controlled by a pressure valve for which the opening pressure can be controlled. The characteristics of the closed-loop control are determined in this case by the pressure control valve.

The pilot control can basically be undertaken in any way. For example neuronal networks or fuzzy-logic systems, which supply the pilot control value depending on the current values of the operating parameters used, can be employed for pilot control. The adaptation can then be undertaken by adapting the parameters of the networks or systems. It is however preferred that a value determined from the deviation assigned to the value of at least one operating parameter is stored for adaptation in an engine map with pilot control parameter values. For this purpose the device preferably features a non-volatile memory in which an engine map with pilot control parameter values used for pilot control is stored. To this end the device is preferably further embodied and the computer program preferably comprises an instruction so that for adaptation the device or the processor stores in an engine map used for pilot control with pilot control parameter values a value determined from the deviation assigned to the value of the at least one operating parameter. In the engine map the pilot control parameter values can be assigned values of the at least one operating parameter and where necessary further values of other operating parameters. One of the advantages of this embodiment is that using an engine map enables the pilot control value to be rapidly determined by the adapted pilot control. Furthermore the adaptation can be performed especially simply by a value of the pilot control parameter assigned to the at least one operating parameter being adapted or changed.

In principle the pilot control can be undertaken in one stage. In this case the pilot control value determined before the adaptation does not absolutely have to be used for the adaptation, since during the adaptation the new pilot control value can be determined from the adaptation value determined or the corrective value in the stationary state of the closed-loop control. For example at least one engine map can be used which for pre-determined combinations of the operating parameter values defining the operating point, has corresponding pilot control values and is adapted starting from predetermined engine map parameter values, with for example an engine map value corresponding to a pilot control value being replaced by the adaptation value or the corrective value in the stationary state. It is preferred however for the pilot control to have a fixed part and an adaptable part, with the fixed part determining an amount for the pilot control value based on predetermined fixed pilot control parameters and with the adaptable part determining a further amount for the pilot control value based on adaptable pilot control parameters of which at least one is adapted during adaptation and at least one current value of the at least one operating parameter. For a pilot control which has a fixed part and an adaptable part the device is preferably further embodied and the computer program preferably comprises an instruction so that the device or the processor for the fixed part determines the amount for the pilot control value based on predetermined fixed pilot control parameters and for the adaptable part determines a further amount for the pilot control value based on the adaptable pilot control parameters, of which at least one is adapted during adaptation and at least one current value of the at least one operating parameter. The fixed pilot control values can in particular be values which were determined by trials or by models for a standard common-rail injection system. The pilot control value can be formed from the two contributions in any manner, preferably by forming sums or differences. The advantage of this embodiment is that a different structure of the pilot control and especially other operating parameters can be used for the fixed part to that used for the adaptable part. The adaptation can be simplified in this way.

In this case a deviation between the pilot control value and the current corrective value or the above-mentioned adaptation value is determined and is adapted depending on the deviation of the adaptable part of the pilot control. The deviation can be determined for at least one of the closed-loop control steps or after a number of closed-loop control steps if a number of corrective values are used to form an adaptation value which will be used for adaptation. A deviation in this case can be taken to mean any given variable which represents a difference between the values, for example a difference between the values or also a quotient of the values. The determination of the deviation and the adaptation using the deviation can also be used for a single-stage pilot control.

It is also preferred for the adaptable part of the pilot control to determine the further contribution for the pilot control value on the basis of a current value of the least one and at least one further operating parameter. To this end the device is further embodied and the computer program comprises an instruction so that the device or the processor determines for the adaptable part the further amount for the pilot control value based on a current value of the at least one and at least one further operating parameter. Since the fixed part of the pilot control can thus contain a number of independent modules for example, it is then possible for the adaptable part of the pilot control to depend on at least two operating parameters and thereby for a more precise adaptation to be undertaken depending on a combination of the at least two operating parameters.

In principle any parameters by means of which the operating state of the internal combustion engine and of the common-rail injection system is at least partly described can be used as operating parameters. Preferably those parameters on which the pressure in the common-rail injection system depends are used as operating parameters. It is especially preferable for the at least one operating parameter and the at least one further operating parameter to be selected from the group of parameters rotational speed of the internal combustion engine, pressure in the common-rail injection system, temperature of fuel in the common-rail injection system and quantity of injected fuel. To this end the device is preferably further embodied and the computer program product preferably comprises an instruction so that the device or the processor uses the at least one operating parameter and the at least one further operating parameter as operating parameters which are selected from the group of parameters rotational speed of the internal combustion engine, pressure in the common-rail injection system, temperature of fuel in the common-rail injection system and quantity of injected fuel. The quantity of injected fuel is in this case the quantity of fuel injected per unit of time or preferably per cycle of the internal combustion engine from the common-rail injection system. Selecting these operating parameters has the advantage of making very exact adaptation possible. It is especially preferable for as many and such operating parameters to be used as essentially uniquely describe the operating point of the internal combustion engine and of the common-rail injection system.

As an alternative or in addition it is preferable for the at least one operating parameter used in the adaptation to be an operating parameter which is formed from at least two of the operating parameters selected from the following list of parameters: Rotational speed of the internal combustion engine, pressure in the common-rail injection system, temperature of fuel in the common-rail injection system and quantity of injected fuel. To this end the device is preferably further embodied and the computer program product preferably comprises an instruction so that the device or the processor uses as an operating parameter the at least one operating parameter used in the adaptation which is formed from at least two parameters which are selected from the parameter group: Rotational speed of the internal combustion engine, pressure in the common-rail injection system, temperature of fuel in the common-rail injection system and quantity of injected fuel. This can lead in an advantageous manner to a simplification of the adaptation on one side and to a faster determination of the pilot control value by the adapted pilot control. When an adaptable engine map is used this can especially also have a smaller dimension and thus require less memory space.

The adaptation in principle only has to occur once. To adapt as many operating states of the internal combustion engine and of the common-rail injection system as possible it is however preferable for the closed-loop control to the required pressure and the adaptation of the pilot control and where necessary the checking of the criteria for sufficient approximation to the required value and/or the determination of the deviation to be undertaken at predetermined intervals and/or on reaching predetermined operating parameter values. To this end the device is further preferably embodied and the computer program product preferably comprises an instruction so that the device or the processor executes the correction to the setpoint pressure and the adaptation of the pilot control and if necessary the checking of the criterion for a sufficient approximation to the setpoint value and/or the determination of the deviation at predetermined intervals and/or on reaching predetermined operating parameter values. In this way the closed-loop control can be adapted automatically without intervention by an operator. Normal closed-loop control can be undertaken between the adaptations, in which the last adapted pilot control is used.

In FIG. 1 an internal combustion engine 1 in the form of a diesel engine has four cylinders, which, including the devices provided for each cylinder, are of the same design and are constructed in the usual way. To simplify the diagram, FIG. 1 only shows one cylinder 2 and the devices provided for it, where these devices are used below in the description; the following description of the equipment then applies equally to the other cylinders. The cylinders are supplied with fuel via a common-rail injection system 3. An engine management device 4, which simultaneously represents a facility for closed-loop control of the pressure in the common-rail injection system 3 according to a first preferred embodiment of the invention, controls the common-rail injection system 3 depending on signals of sensors on the internal combustion engine and the common-rail injection system 3 and thus also controls the pressure of the fuel within them.

The internal combustion engine 1 has a drive shaft in the form of a crankshaft 5, to which the movement of the pistons 7 in the cylinders 2 is transmitted via connecting rods 6. A speed sensor 8 detects the speed of rotation N of the crankshaft 5 and issues corresponding rotational speed signals.

The common-rail injection system 3 has a fuel supply line 9 from a fuel tank not shown in the figures, in which, arranged one after the other in the direction of flow of the fuel, are a pre-feed pump such as a vane pump 10 and a correction device in the form of a flow control valve 11 able to be controlled by corrective signals for correcting the flow of fuel through the supply line as well as a high-pressure pump 12 driven by the drive shaft 5. The high-pressure pump 12 pressurizes the fuel via a pressure control valve 13 only shown very schematically in the drawing into a pressure line 14 connected to the high-pressure pump 12.

Connected to the pressure line 14 are electrically-actuatable injection valves 15, not shown separately in the figures, which lead to injection nozzles in the cylinders 2.

In or on the pressure line 14 are arranged a pressure sensor 16 for detecting the pressure in the fuel in the pressure line 14 and a temperature sensor 17 for detecting the temperature of the fuel in the pressure line 14, which generate pressure or temperature signals which represent the pressure or the temperature of the fuel in the pressure line 14.

The engine management device 4 controls the internal combustion engine and especially the common-rail injection system 3 and controls parameters including the pressure of the fuel in the pressure line 14, with an adaptation of a pilot control of the closed-loop pressure control being undertaken at fixed intervals according to a preferred embodiment of the invention. The engine management device 4 to this extent represents a preferred embodiment of a device for controlling the pressure in the common-rail injection system.

For this purpose it has a memory 18 with a non-volatile section, a processor 19 which accesses the memory 18, as well as input and output interfaces connected to the processor 19 with inputs or outputs, which for reasons of clarity are only labeled in the figures by input or output reference symbols in some cases.

An engine speed signal input 20 of the engine management device 4 is connected to the engine speed sensor 8 and is used for detecting speed signals of the engine speed sensor 8, which represent the rotational speed of the crankshaft 5 and thus of the internal combustion engine 1 as operating parameters.

A pressure signal interface with a pressure signal input 21 and a temperature signal interface with a temperature signal input 22 of the engine management device 4 are connected to the pressure sensor 16 or the temperature sensor 17 and allow the pressure or temperature signals emitted by the sensors in each case to be detected, which represent the pressure or the temperature of the fuel in the common-rail injection system 3, or more accurately in the pressure line 14, as operating parameters.

A flow control valve output 23 connected to the flow control valve 11 and a pressure control valve output 24 of the engine management device 4 connected to the pressure control valve 13 are used for output of flow control valve control signals or pressure control valve control signals to the flow control valve 10 or the pressure control valve 13 respectively.

The engine management device 4 finally also has injection signal outputs 25 for output of injection signals to the injection valves 15.

A computer program product with instructions for executing the method for adaptation of a pilot control of a closed-loop control of the pressure in the common-rail injection system 3 including the closed-loop control itself described below, is stored in the non-volatile part of the memory 18 along with fixed pilot control parameter engine maps 26 and an adaptation engine map 27 described in greater detail below.

The computer program product further contains instructions for control of the common-rail injection system 3, especially of the injection valves 14 and of the pressure control valve 12. This control is undertaken in the known manner.

In normal operation the engine management device 4, by means of the processor 19 and an engine map corresponding to a predetermined load or a predetermined engine speed, uses known methods to generate injection signals to briefly open the injection valves 15, by first determining from the torque or the load desired injection volumes and by taking into account the prevailing pressure in the pressure line 14, determining by means of the engine map valve opening times for all injection valves.

Figure 2:
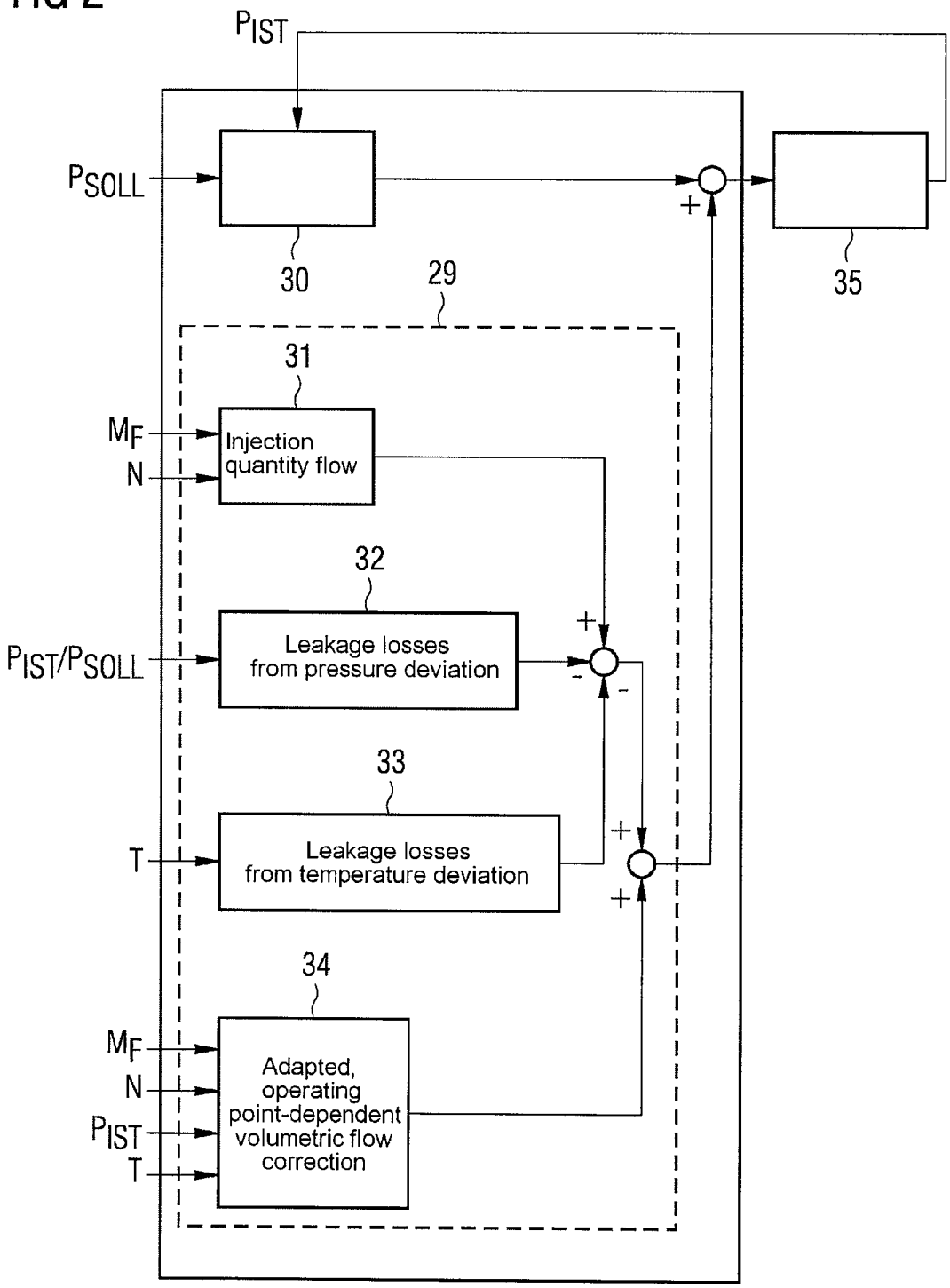
Figure 3:
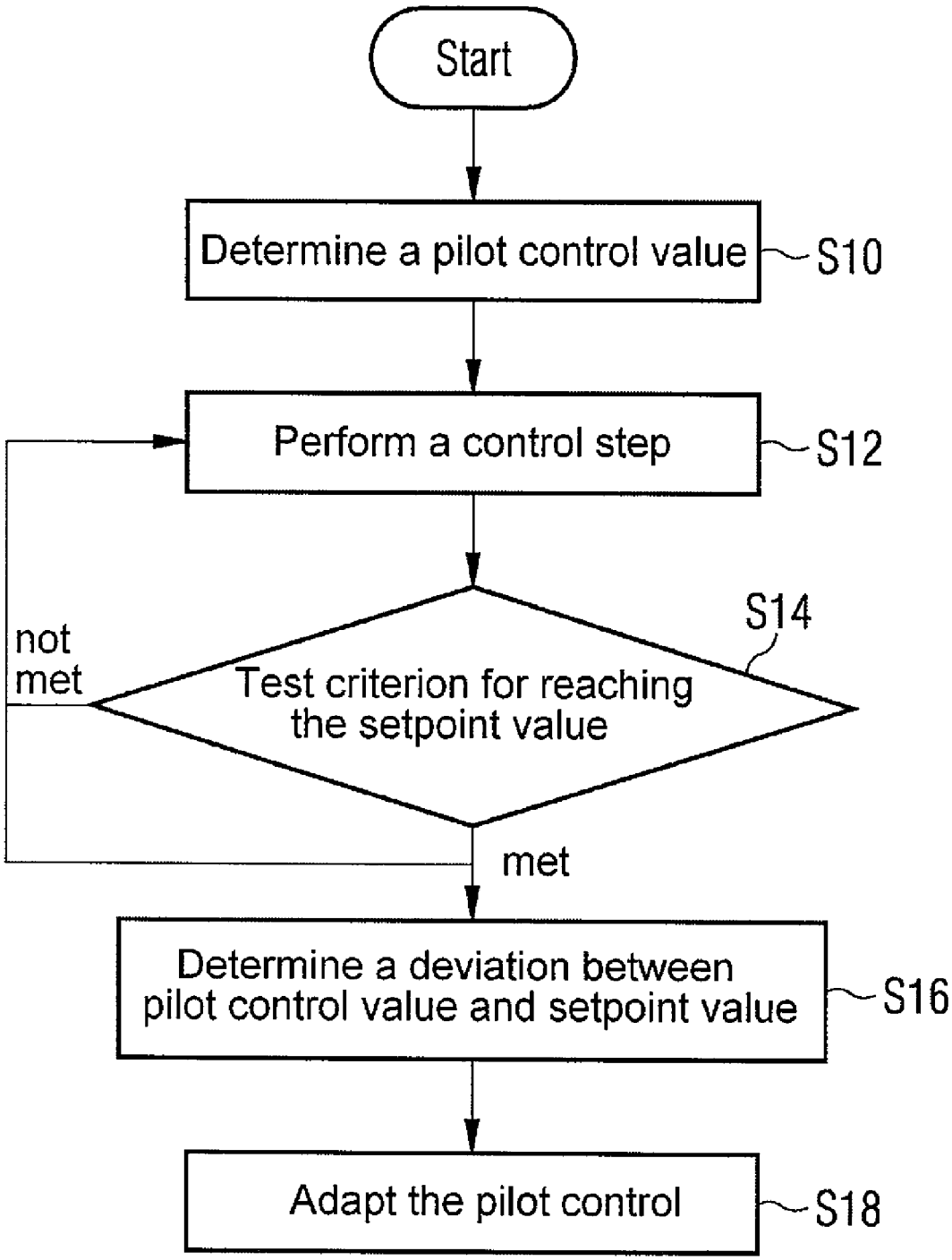

The pressure in the pressure line 14 is controlled using the method illustrated in FIG. 2, which shows the closed-loop control in a simplified block diagram.

First of all the engine management device 4 determines in a known manner, as a function of the operating state of the internal combustion engine 1 and the torque requirement, a setpoint pressure $P_{SOLL}$ as a guide variable which is to be used for correction in the pressure line 14.

Furthermore the injection quantity $M_F$, i.e. the mass of the fuel to be injected by the common-rail injection system 3 is likewise determined in the known manner by the engine management device 4 as a function of the operating state of the internal combustion engine 1 and of the torque requirement.

In addition engine speed, temperature and pressure signals are detected by the engine management device via the specified input interfaces from which the speed N of internal combustion engine, the temperature T of the fuel in the common-rail injection system 3, and the current pressure $P_{IST}$ in the pressure line 14 are determined as values of detected operating parameters.

The pressure is controlled in two parts. In the first part, a pilot control 29, on the basis of the operating parameters injection quantity $M_F$, speed N, pressure ratio $P_{IST}/P_{SOLL}$ and temperature T, a necessary fuel flow to be expected based on the values of these operating parameters, is determined as a pilot control value or as a first contribution to a corrective value. Since however this fuel flow, for example as a result of manufacturing or age-related deviations in the common-rail injection system 3 from a standard system and fluctuations, does not lead absolutely necessarily to the desired pressure in the pressure line 14, a closed-loop controller 30 is provided as a second part, which determines as a function of the setpoint pressure $P_{SOLL}$ and the actual pressure $P_{IST}$ a second fuel flow as a second contribution to the corrective value. A corrective value for the flow control valve 11 is formed, in the example by summation, from the two contributions, from which corrective signals for the flow control valve 11 are then generated and issued to the latter.

The pilot control 29 in the example comprises in detail the following modules produced by instructions of the program and engine maps, modeling volumetric part flows of the fuel in the common-rail injection system 3. The pilot control 29 itself again comprises two parts, namely a fixed part and an adaptable part, with modules 31 to 34 respectively.

The fixed part is designed to take separate account of the different fuel flows to be expected into or out of the pressure line in the modules 31 to 33 in each case. The individual modules can thus be determined easily and can be determined by trials with a standard system.

Module 31 serves to describe the flow of fuel by the injection process through the injection valve 15, i.e. the injection quantity flow, and creates a value for a first part fuel flow as a function of the engine speed N and the quantity of injected fuel $M_F$ per cycle calculated by the engine management device.

Module 32 serves to take account of leakage losses which arise when with pressures in the pressure line 13, fuel at the opening pressure of the pressure control valve 13 embodied as a pressure-relief valve escapes through the pressure control valve 13. The opening pressure is the setpoint pressure $P_{SOLL}$ in each case, so that the value for a corresponding second part fuel flow is determined as a function of the ratio $P_{IST}/P_{SOLL}$ of the actual pressure to the setpoint pressure.

Module 33 is provided for description of leakage losses arising from deviation of the current temperature from a fixed predetermined reference temperature. The value of the corresponding third partial flow depends on the currently detected temperature T.

The dependencies in these modules 31 to 33 are produced by corresponding engine maps or pilot control engine maps 26 which are determined for a common-rail-injection system set as a standard on the basis of models or empirically-defined. The values of the pilot control parameters in the pilot control engine maps 26 are fixed and will not be adapted.

Module 34, which represents the adaptable part of the pilot control, finally serves for operating-point dependent volumetric flow correction and can be adapted with the method still to be described below. It describes how the characteristics of the actual available individual common-rail injection system 3 differ from those of the standard injection system in relation to modules 31 through 33. In this exemplary embodiment a fourth partial flow is determined by means of this module depending on four operating parameters which represent at least partly the operating point of the internal combustion engine 1 and of the common-rail injection system 3, namely the engine speed N, the injection quantity $M_F$, the pressure $P_{IST}$ and the temperature T. A corresponding engine map dependent on the four operating parameters, the adaptation engine map 27 with corresponding adaptation parameters, is used for this purpose, with interpolation methods being able to be used between the checkpoints of the adaptation engine map. The adaptation engine map 27 is set to zero before the very first adaptation.

The four partial flows, depending on whether they represent inflows, as from module 30, or outflows, will be added together into a pilot control value, which represents a first contribution to a corrective value.

Since the actual pressure $P_{IST}$ can deviate from the setpoint pressure $P_{SOLL}$, the closed-loop controller 30 is provided as the second part of the closed-loop control. In the example this is a PID controller, which uses the setpoint pressure $P_{SOLL}$ as a guide variable and determines the second contribution to the corrective value for the flow control valve 11. This closed-loop controller, like the pilot control, is provided by corresponding instructions in the program executed by the processor 19, but could also be implemented in a similar fashion in other exemplary embodiments.

The corrective value is then created from the two contributions and from this, using an engine map for the flow control valve 11, a corrective signal is generated and output to the flow control valve 11. In the exemplary embodiment the corrective signal is a pulse-width modulated or PWM signal.

The control path, i.e. the section from the correction device 11 up to the pressure sensor 15, is depicted schematically by block 35 in FIG. 2. The flow control valve 11 alters its opening as a function of the corrective signal, with the pressure in the pressure line 14 being influenced.

The following method, which in practice is repeated at fixed intervals, is used for adaptation, to enable the adaptation engine map 27 to be adapted for as many combinations of operating parameter values as possible.

Initially, in step S10, as in the normal, closed-loop control method, a pilot control value for generating at least one corrective signal is determined for the correction device, i.e. the flow control valve 11, to which end the processor 19, after detecting the values of the operating parameters engine speed N, injection quantity $M_F$, temperature T and actual pressure $P_{IST}$, and determination of the setpoint pressure $P_{SOLL}$ determines the first contribution to the corrective value as pilot control value with reference to modules 31 through 34.

While the pilot control value is constant, by means of the controller 30 in step S12 using the pilot control value by generation and output of the at least one corrective signal, which corresponds to a corrective value for the correction device, the current pressure is corrected at the correction device to a predetermined setpoint pressure. To this end, in step S12 by means of the controller 30, depending on the setpoint and the actual value $P_{SOLL}$ or $P_{IST}$, the second contribution to the corrective value is calculated and after addition of the two contributions for forming the corrective value from the corrective value received, a corresponding corrective signal is generated and issued to the pressure control valve 11.

In step S14 a check is made as a criterion for a sufficient approximation to the setpoint pressure $P_{SOLL}$ as to whether the deviation between actual and setpoint value of the pressure in the pressure line 14 for a predetermined number L of previous steps processed immediately after each other is less than a value G predetermined as a function of the accuracy of the closed-loop control.

In each case a new actual value $P_{IST}$ of the pressure is then detected and step S12 is executed repeatedly.

Only if, when the criterion is checked, it was established that the deviation between actual and setpoint value of the pressure in the pressure line 14 for a predetermined number L of steps executed previously immediately after one another was less than a limit value G dependent on the accuracy of the closed-loop control, that is if the criterion is fulfilled, will a deviation, in the example a difference, between the pilot control value used and the corrective value, be determined in step S16. This represents how accurately the pilot control is adjusted. With perfectly adjusted pilot control the deviation must be zero, but as a rule this does not however need to be the case.

Therefore, in step S18, for adaptation of the pilot control, this control is adapted as a function of at least one current operating parameter of the internal combustion engine and adapted to the deviation determined. To this end the value of the engine map parameter of the adaptation engine map 27, which is assigned to the values of the current prevailing operating parameters, is changed so that for the values of the operating parameters the pilot control already produces a pilot control value which matches the corrective value. The value can for example be determined by also deducting from the difference between corrective value and pilot control value the contributions of the fixed part of the pilot control to the pilot control value for the given values of the operating parameters.

After a predetermined period of time has elapsed the method is repeated.

A second preferred embodiment of the invention differs from the first exemplary embodiment in that the adaptation engine map 27 now only depends on one independent operating parameter, which at least partly identifies the operating point of the internal combustion engine, such as for example the fuel volume ($N*M_F$=speed*injection quantity). Other dependencies are ignored however.

A third preferred embodiment of the invention differs from the first exemplary embodiment in that, for the adaptation not just one corrective value and one pilot control value, i.e. a corresponding deviation, but a number of corrective values are used for the same pilot control value, from which the adaptation value is formed by forming a floating average. The deviation between the adaptation value and the pilot control value is then determined. The adaptation itself is undertaken as in the first exemplary embodiment using the deviation. Except for the corresponding programming of the control unit, the device is also unchanged from the first exemplary embodiment.

A fourth preferred embodiment of the invention differs from the first exemplary embodiment in that PCV control, not VCV control, is performed. This means that the programming of the microprocessor 19 is changed so that a corresponding closed-loop control and an adaptation method according to a third preferred embodiment of the invention are executed. All other components of the arrangement in FIG. 1 are unchanged, so that the same reference symbols are used for these and the explanations of the first exemplary embodiment also apply correspondingly here.

A control variable for the pressure control valve 13 now serves as corrective variable, which in this exemplary embodiment represents the correction device.

Figure 4:
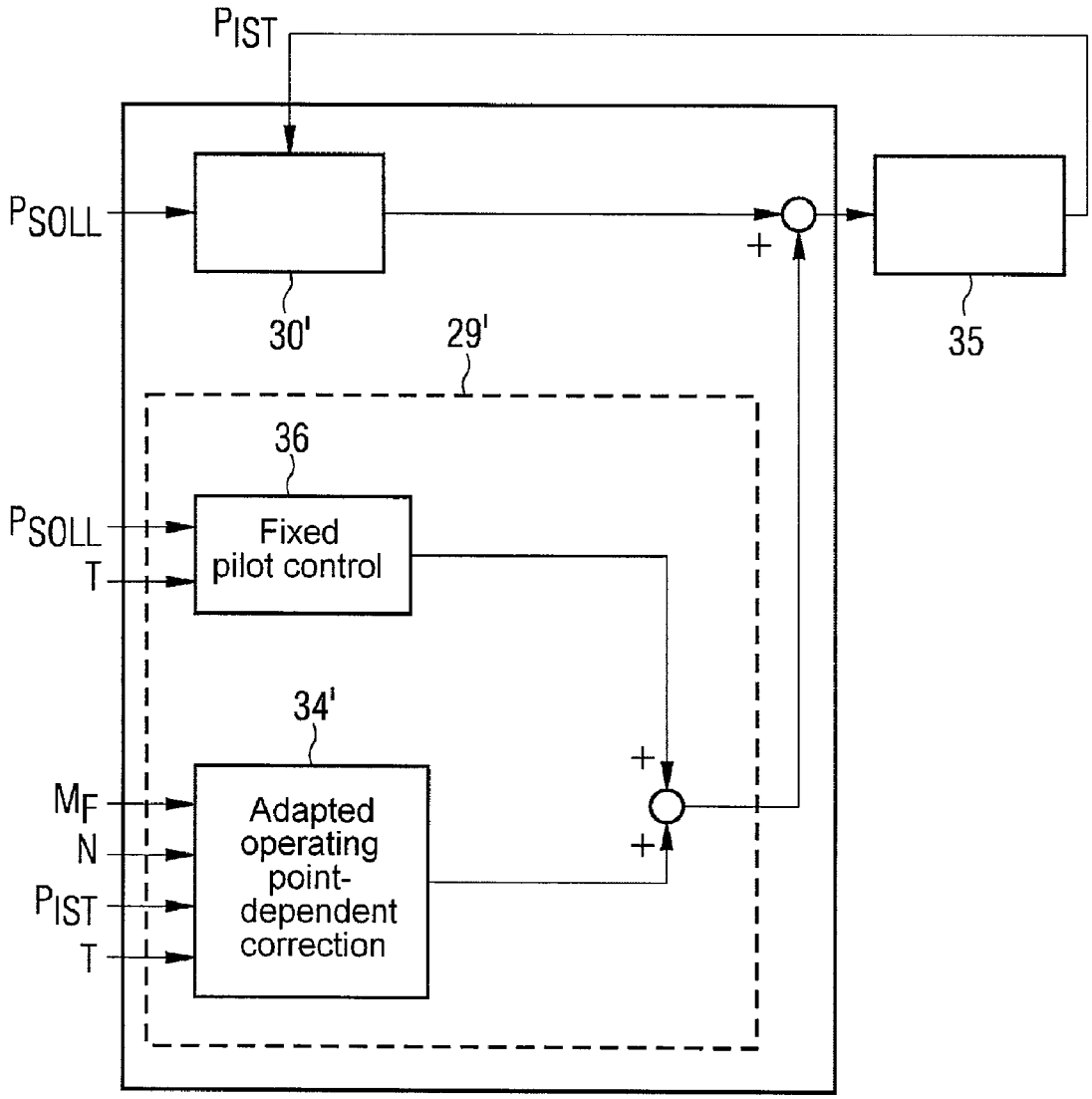

The pilot control 29 is now replaced by a pilot control 29' which is altered to the extent of only one module 36 being provided in the fixed part of the pilot control (cf. FIG. 4), which determines a corresponding contribution to the pilot control value for the corrective value for the opening of the pressure control valve as a function of the temperature T of the fuel and the setpoint pressure of the fuel. To this end a corresponding pilot control engine map is provided which is not shown in the figures.

The module 34 with the adaptation engine map 27 is replaced by a correspondingly changed module 34' which is designed for determination of the now other pilot control or corrective value.

The pilot control value, in a similar manner to the first exemplary embodiment, is determined by adding the contributions of the fixed part of the pilot control, i.e. of the module 36, and the adaptable part of the pilot control i.e. the module 34', and represents the first contribution to the corrective value.

Instead of the closed-loop controller 30 a closed-loop controller 30' is provided, which operates like the controller 30, but determines as a second contribution for the corrective value a value corresponding to the corrective variable now used.

After determination of the corrective value from the two contributions to this, the processor 19 generates corrective signals on the basis of the corrective value and issues these to the pressure control valve 13, whereby the opening pressure of the valve is corrected.

All other steps are executed as in the first exemplary embodiment.

A fifth preferred embodiment of the invention differs from the first exemplary embodiment in that a number of corrective values which were determined for the same pilot control value are used for adaptation of pilot control. The only difference between the device used for this and the device of the first exemplary embodiment lies in the fact that a modified program for executing the third preferred embodiment of the method is stored in the memory compared to the program of the first exemplary embodiment.

Figure 5:
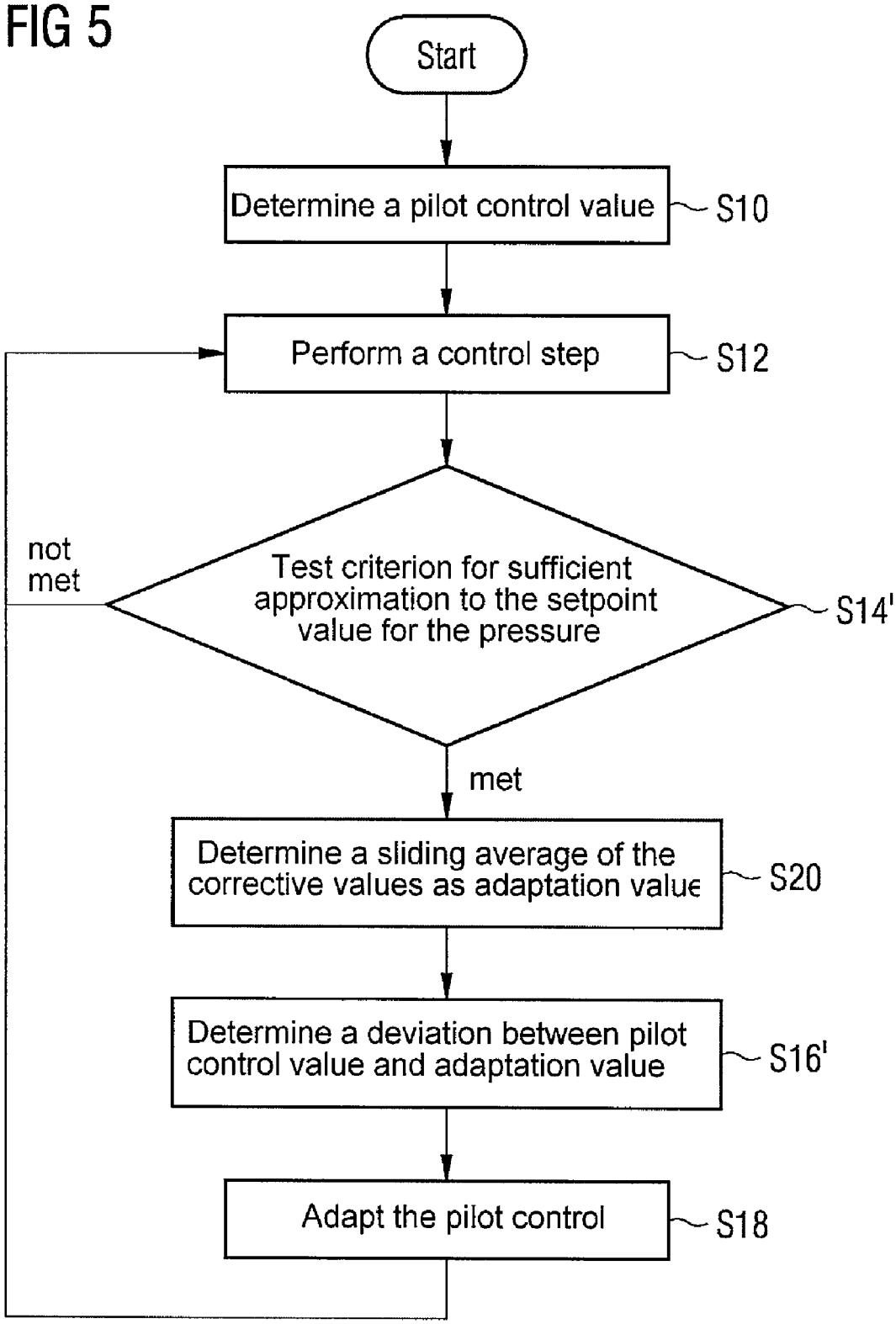

In the method of the third exemplary embodiment, which is schematically depicted in outline form in FIG. 5, the steps S10, S12 and S18 are executed as in the first exemplary embodiment.

Step S14 is replaced by a step S14', in which a check is now made as to whether the state controlled for the adaptation by the closed-loop control has been sufficiently approximated to the stationary state i.e. the actual pressure to the setpoint pressure. To this end for example the last local minima and maxima of the corrective value can be determined. As criteria for example a check can be made as to whether the amount of the difference between minima and maxima differs by less than a predetermined factor, for example defined by the area of linearity of the closed-loop control from the average of minimum and maximum. If this is the case, and the criterion is thus fulfilled, step S20 is executed, otherwise a new control step S12 is performed.

In step S20 a floating average of a predetermined number of corrective values is formed as adaptation value for the same pilot control value. The number of steps in this case can especially be selected as a function of the speed or time constant, with which the closed-loop control synchronizes in the stationary state, as well as the typical synchronization frequency. The adaptation value is determined as it would be using only those corrective values which were detected after fulfillment of the criterion and before a change of the pilot control value.

Step S20 is followed by step S16', which only differs from step S16 of the first exemplary embodiment in that, instead of the corrective value, the adaptation value is used to determine the deviation.

Unlike the method of the first exemplary embodiment there is only a return to the next control step S12 after the step S18 following the step S16'.

In this way an increased accuracy and/or speed of the adaptation can be achieved.

Although this does not absolutely need to be the case, in the exemplary embodiment depicted the adaptation is aborted as soon as the pilot control value changes. A corresponding checking step is provided for this purpose which is not shown in the figures.

In other exemplary embodiments it is also possible for the method not to return to step S12 but to step S10 of the closed-loop control.

What is claimed is:

1. A method for adaptation of a closed-loop pressure control in a common-rail injection system for an internal combustion engine, with the closed-loop control comprising a pilot control and the common-rail injection system comprising at least one correction device able to be adjusted by corrective signals which correspond to respective corrective values for influencing the pressure, the method comprising the steps of:

determining a pilot control value for generating at least one corrective signal for the setting device, correcting the current pressure to a predetermined setpoint pressure using the pilot control value by generation of the at least one corrective signal and issuance to the correction device, and for adaptation, adapting the pilot control as a function of at least one current value of an operating parameter of the internal combustion engine and of the corrective value corresponding to the at least one corrective signal.

2. The method according to claim 1, wherein at least two corrective values are determined at different points in time and during the adaptation the pilot control is adapted as a function of the at least two corrective values.

3. The method according to claim 1, wherein the corrective value or the corrective values is or are only used for adaptation if this value or these values was or were determined after a sufficient approximation of the setpoint pressure according to a predetermined criterion.

4. The method according to claim 1, wherein the correction device comprises a flow control valve for control of the flow of fuel fed to a pressure line of the common-rail injection system and the corrective signals are corrective signals for the flow control valve.

5. The method according to claim 1, wherein the correction device comprises a pressure-relief valve for control of the pressure in a pressure line of the common-rail injection system and the corrective signals are signals for the pressure relief valve.

6. The method according to claim 1, wherein for adaptation, a value determined from the pilot control value and the corrective value or a deviation between these two values assigned to the value of the at least one operating parameter is stored in an engine map used for pilot control with pilot control parameter values.

7. The method according to claim 1, wherein the pilot control has a fixed part and an adaptable part, with the fixed part determining a contribution for the pilot control value based on predetermined fixed pilot control parameters and with the adaptable part determining a further contribution to the pilot control value on the basis of adaptable pilot control parameters, of which at least one is adapted during adaptation, and at least one current value of the at least one operating parameter.

8. The method according to claim 7, wherein the adaptable part determines the further contribution for the pilot control value on the basis of a current value of the at least one and at least one further operating parameter.

9. The method according to claim 8, wherein the at least one operating parameter and the at least one further operating parameter are selected from the following parameters Engine speed of the internal combustion engine, Pressure in the common-rail injection system, Temperature of fuel in the common-rail injection system and Quantity of injected fuel.

10. The method according to claim 7, wherein the at least one operating parameter used in the adaptation being an operating parameter which is formed from at least two of the operating parameters which are selected from the following parameters: Engine speed of the internal combustion engine, pressure in the common-rail injection system, temperature of fuel in the common-rail injection system and quantity of injected fuel.

11. A device for closed-loop pressure control in a common-rail injection system for an internal combustion engine, comprising:

a closed-loop control comprising a pilot control and the common-rail injection system comprising at least one correction device able to be corrected by corrective signals which correspond to respective corrective values for influencing the pressure, input interfaces for operating parameter signals which represent values of operating parameters of the internal combustion engine, and for pressure signals which represent values of the pressure in the common-rail injection system, an output interface for output of corrective signals to the correction device for influencing the pressure and being designed for determining a pilot control value to generate at least one corrective signal for the correction device, to correct the current pressure to a predetermined setpoint pressure using the pilot value by generating the at least one corrective signal which corresponds to a setpoint value for the correction device and issuing it to the correction device, and to adapt the pilot control depending on at the least one current value of an operating parameter of the internal combustion engine and the corrective value corresponding to at least one corrective signal.

12. A computer program product comprising instructions stored on a computer readable medium, with said program carrying out a method for adapting closed-loop pressure control in a common-rail injection system for an internal combustion engine, with the closed-loop control comprising a pilot control and the common-rail injection system comprising at least one correction device able to be adjusted by corrective signals which correspond to respective corrective values for influencing the pressure, on execution of the instructions by a processor of the data processing system comprising the steps of:

determining a pilot control value by the processor for generating at least one corrective signal for the correction device, using the pilot control value by generating and issuing the at least one corrective signal which corresponds to a setpoint value for the correction device, to the correction device, regulating the current pressure to a predetermined setpoint pressure, and adapting the pilot control as a function of at least one current value of an operating parameter of the internal combustion engine and of the corrective value corresponding to the at least one corrective signal.

13. A system for adaptation of a closed-loop pressure control in a common-rail injection system for an internal combustion engine, with the closed-loop control comprising a pilot control and the common-rail injection system comprising at least one correction device able to be adjusted by corrective signals which correspond to respective corrective values for influencing the pressure, comprising:

means for determining a pilot control value for generating at least one corrective signal for the setting device, means for correcting the current pressure to a predetermined setpoint pressure using the pilot control value by generation of the at least one corrective signal and issuance to the correction device, and means for adapting the pilot control as a function of at least one current value of an operating parameter of the internal combustion engine and of the corrective value corresponding to the at least one corrective signal.

14. The system according to claim 13, wherein at least two corrective values are determined at different points in time and during the adaptation the pilot control is adapted as a function of the at least two corrective values.

15. The system according to claim 13, wherein the corrective value or the corrective values is or are only used for adaptation if this value or these values was or were determined after a sufficient approximation of the setpoint pressure according to a predetermined criterion.

16. The system according to claim 13, wherein the correction device comprises a flow control valve for control of the flow of fuel fed to a pressure line of the common-rail injection system and the corrective signals are corrective signals for the flow control valve.

17. The system according to claim 13, wherein the correction device comprises a pressure-relief valve for control of the pressure in a pressure line of the common-rail injection system and the corrective signals are signals for the pressure relief valve.

18. The system according to claim 13, wherein for adaptation, a value determined from the pilot control value and the corrective value or a deviation between these two values assigned to the value of the at least one operating parameter is stored in an engine map used for pilot control with pilot control parameter values.

19. The system according to claim 13, wherein the pilot control has a fixed part and an adaptable part, with the fixed part determining a contribution for the pilot control value based on predetermined fixed pilot control parameters and with the adaptable part determining a further contribution to the pilot control value on the basis of adaptable pilot control parameters, of which at least one is adapted during adaptation, and at least one current value of the at least one operating parameter.

20. The system according to claim 19, wherein the adaptable part determines the further contribution for the pilot control value on the basis of a current value of the at least one and at least one further operating parameter.

21. The system according to claim 20, wherein the at least one operating parameter and the at least one further operating parameter are selected from the following parameters Engine speed of the internal combustion engine, Pressure in the common-rail injection system, Temperature of fuel in the common-rail injection system and Quantity of injected fuel.

22. The system according to claim 19, wherein the at least one operating parameter used in the adaptation being an operating parameter which is formed from at least two of the operating parameters which are selected from the following parameters: Engine speed of the internal combustion engine, pressure in the common-rail injection system, temperature of fuel in the common-rail injection system and quantity of injected fuel.

* * * * *